US005469598A

United States Patent [19]

Sales

[11] Patent Number: 5,469,598

[45] Date of Patent: Nov. 28, 1995

[54] MOBILE SYSTEM CLEANING APPARATUS

[76] Inventor: John K. Sales, P.O. Box 151 J, Lawson, Mo. 64062

[21] Appl. No.: 186,613

[22] Filed: Jan. 26, 1994

[51] Int. Cl.[6] ..... A47L 7/00

[52] U.S. Cl. ..... 15/321; 15/339; 122/17

[58] Field of Search ..... 15/321, 340.1, 15/320; 122/17

[56] References Cited

U.S. PATENT DOCUMENTS

| | | | |
|---|---|---|---|
| 2,586,569 | 2/1952 | Sedgwick . | |
| 3,594,849 | 7/1971 | Coshow . | |
| 3,775,053 | 11/1973 | Wisdom . | |
| 4,109,340 | 8/1978 | Bates . | |
| 4,158,248 | 6/1979 | Palmer . | |
| 4,207,649 | 6/1980 | Bates . | |
| 4,284,127 | 8/1981 | Collier et al. . | |
| 4,336,627 | 6/1982 | Bascus . | |
| 4,443,909 | 4/1984 | Cameron . | |
| 4,593,753 | 6/1986 | McConnell . | |
| 4,803,466 | 2/1989 | Gurstein et al. | 15/321 X |
| 4,862,551 | 9/1989 | Martinez et al. . | |
| 4,940,082 | 7/1990 | Roden . | |
| 4,949,424 | 8/1990 | Shero . | |
| 4,991,254 | 2/1991 | Roden et al. . | |
| 5,371,918 | 12/1994 | Shero | 15/321 |

*Primary Examiner*—Christopher K. Moore
*Attorney, Agent, or Firm*—Litman, McMahon and Brown

[57] ABSTRACT

An apparatus for producing heated water, including steam, to be used as a cleaning fluid, includes an internal combustion engine, a water heating assembly, a vacuum generating device, a cleaning assembly and a dirty water collector. The heating assembly includes piping and three heat exchangers. Two of the heat exchangers are located to receive exhaust gas directly from exhaust ports respectively of the engine. The third heat exchanger receives a mixture of gas which includes residual exhaust gases from the first and second heat exchangers and the output of the vacuum generator. Water is preheated in the third heat exchanger and finally heated in the first and second heat exchangers. The heated water is used at the cleaning assembly and partially reclaimed by the vacuum generator. Condensed water and dirt are collected in the collector and water vapor is further heated by and passed through the vacuum generator to the third heat exchanger.

7 Claims, 3 Drawing Sheets

MOBILE SYSTEM CLEANING APPARATUS

BACKGROUND OF THE INVENTION

The present invention relates to an apparatus for heating water for producing a hot water and steam mixture and a cleaner utilizing the mixture. The apparatus further recovers dirty water from the article being cleaned and recovers heat from the dirty water to preheat incoming fresh water.

Steam cleaning devices are becoming very popular for use in cleaning a wide variety of items, especially rugs, but also including upholstery, fabric covered furniture and the like. Because many of the items to be cleaned are permanently installed or difficult to move, the steam cleaning apparatus must usually go to the site where cleaning is to occur. Consequently, the apparatus for many modern cleaners of this type is truck mounted.

Throughout the day a truck mounted cleaning unit will be required to produce a substantial amount of high pressure hot or even super heated water and/or steam. Normally, this water is originally supplied to the truck at the site of the cleaning through a hose, but may be carried to the site, if water is not available. As this water is usually at an ambient temperature or cooler, the water must be heated substantially by the apparatus in order for it to be usable.

One of the most common ways of heating water for this purpose is by means of a hydrocarbon fueled internal combustion engine. In particular, heat produced by the engine, especially the exhaust is transferred to the water. However, a substantial amount of the heat generated by the engine is wasted making it difficult for even a large engine to produce enough heated water to keep up with a heavy demand which in turn slows work or requires replacement of the engine with a larger engine having a greater purchase cost and a greater operating cost.

Consequently, it is desirable to make highly efficient usage of a smaller engine with a relatively low operating cost.

One of the inefficient features of the prior art devices used for this purpose has been that, while exhaust has been used to heat the water, the heat exchanger for heating the water with the exhaust is normally substantially removed from the engine exhaust parts. This is done to allow the exhaust gas to cool in the exhaust manifold before entering the heat exchanger, as the gas directly exhausting the manifold are hot enough to melt or deform conventionally used heat exchangers.

Secondly, once the exhaust gas leaves the primary heat exchanger it is normally simply wasted.

Thirdly, waste water and steam that are recovered by vacuum after cleaning are not used further and the residual heat therein is wasted.

Fourthly, the waste water returning from the cleaning process with dirt and the like is drawn by a vacuum compressor. When operating under a load, especially heavy loads, the vacuum compressor further heats the air, water and steam being drawn through the compressor. In conventional systems this heated air and water is wasted.

SUMMARY OF THE INVENTION

An apparatus is provided for producing a heated water and steam mixture for use in cleaning operations. The apparatus includes primary heat generating means that is preferably a gasoline powered internal combustion engine; a water supply system for supplying tap water to the apparatus; a first heat exchanger apparatus for preheating the tap water with a secondary exhaust gas stream, heat recovered from waste water and steam and heat generated by a vacuum generator; a second heat exchanger for producing the mixture by heating the preheated water with exhaust gas directly from the engine; a cleaning wand assembly for delivery of the heated water and steam mixture to a cleaning head; vacuum generator means for recovering dirty water and steam after use and collection means which is preferably a tank for collecting dirty water.

OBJECTS AND ADVANTAGES OF THE INVENTION

Therefore, the principal objects of the present invention are: to provide a mobile heated water cleaning apparatus that efficiently utilizes heat produced by an internal combustion engine to heat water for use by the apparatus; to provide such an apparatus that provides primary heating of the water through a heat exchanger that is configured and constructed to transfer heat to the water from exhaust gas directly at the exit of the exhaust gas from the engine; to provide such an apparatus including a secondary heat recovery system; to provide such an apparatus wherein the secondary heat recovery system utilizes heated gas exiting the primary exhaust gas heat exchanger to preheat the water; to provide such an apparatus including a vacuum compressor to recover spent water and steam and wherein heat generated by the compressor is recovered to preheat the water; to provide such a secondary heat recovery system that further recovers heat from spent steam and water to preheat fresh water; to provide such an apparatus that efficiently utilizes the heat produced by an engine so as to reduce original engine size and cost as well as operating cost; and to provide such an apparatus that is easy to use, economical to operate and especially adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
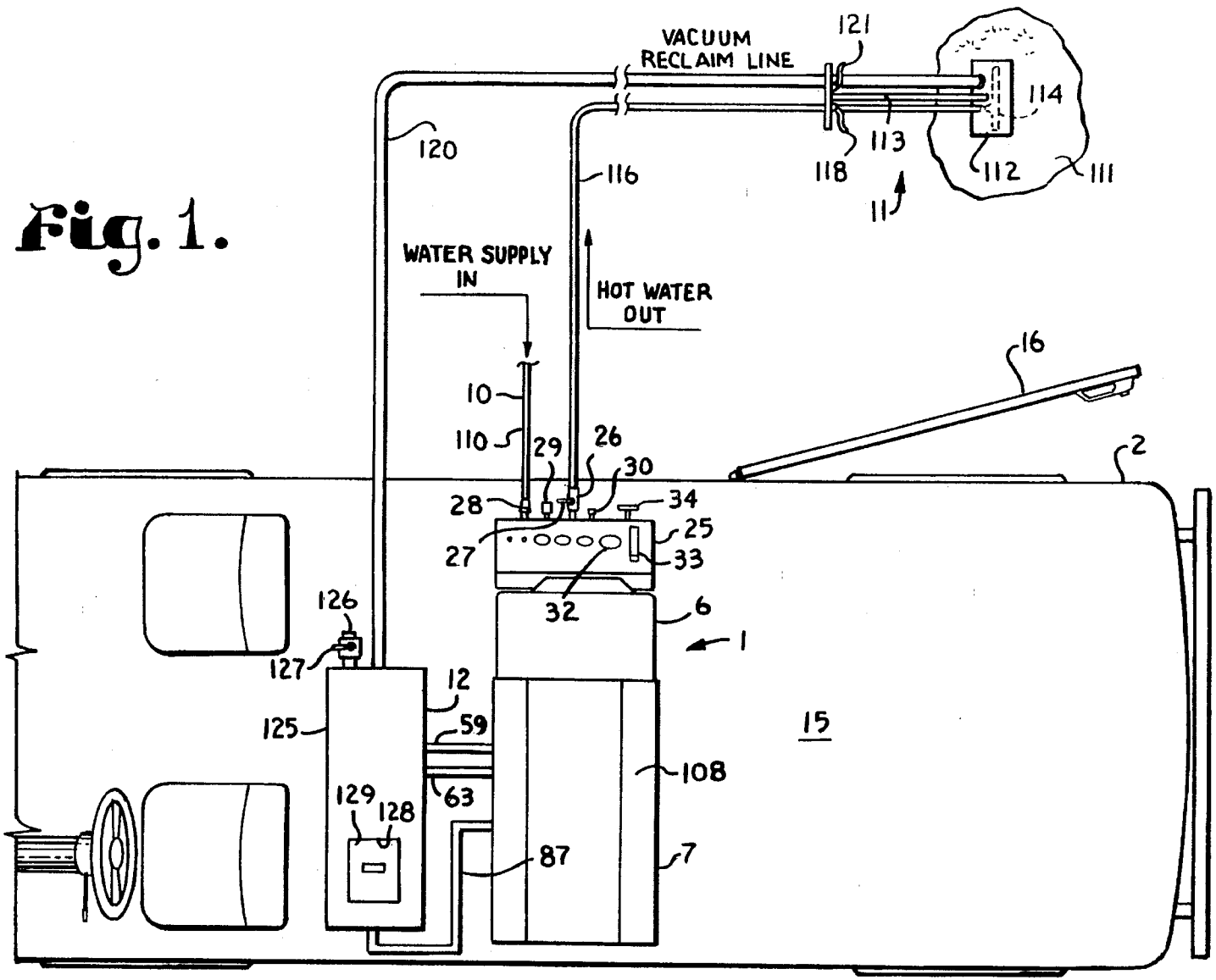
FIG. 1 is a diagrammatic top plan view of a cleaning apparatus in accordance with the present invention showing a heated water generating unit, a dirty water recovery tank and a cleaning wand with hoses.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a hot water or steam cleaning apparatus mounted within a van 2.

The steam cleaning apparatus 1 generally includes a support frame 5 (FIG. 5) upon which is mounted an internal combustion engine 6 (FIG. 1) and a cleaning fluid heating assembly 7. The steam cleaning apparatus 1 further includes a water source 10, a cleaning wand assembly 11 and collection means such as the illustrated dirty water collection apparatus 12.

Figure 3:
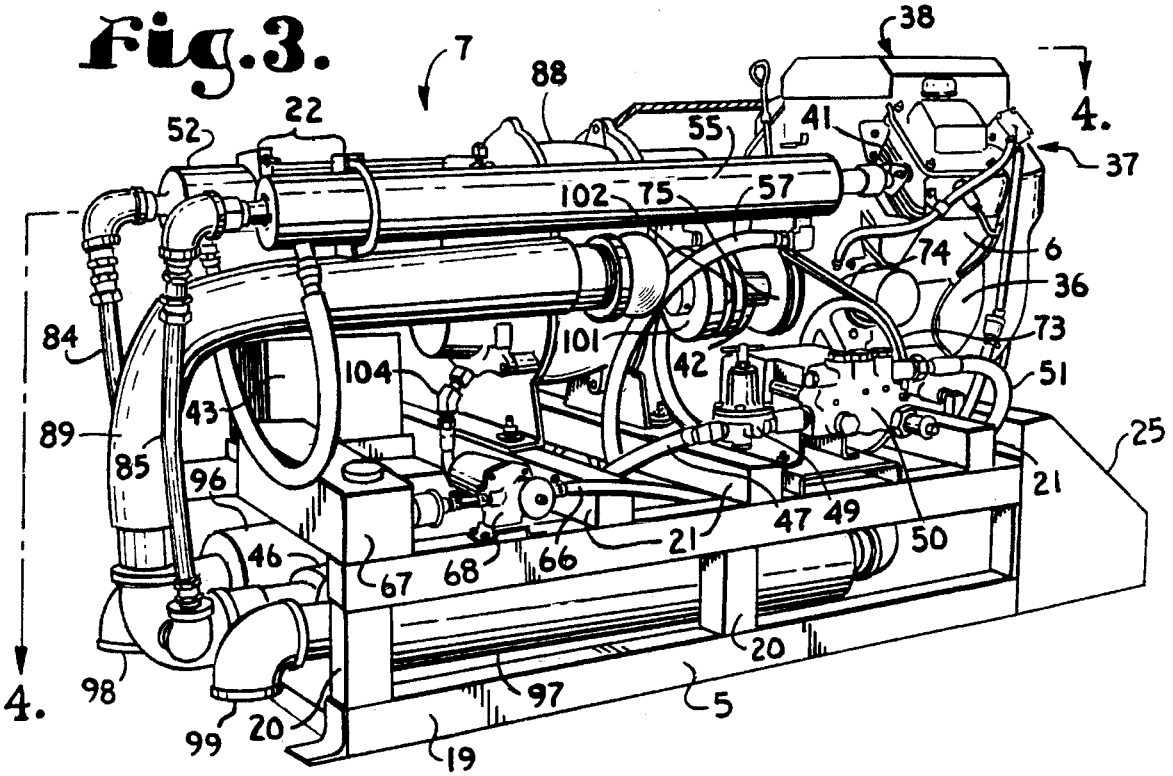
FIG. 3 is a perspective view on an enlarged scale of the heated water generating unit.

As can be seen in FIG. 3 the support frame 5 with the internal combustion engine 6 and heating assembly 7 are mounted in the cargo bay area 15 of the van 2. Also mounted in the cargo bay area 15 is the dirty water collection apparatus 12. As is shown in FIG. 1, while in use, a side door 16 of the van is opened and the water source 10 is run from an available source of water to the fluid heating assembly 7. Likewise the wand apparatus 11 is removed from the van 2 and taken to the site to be cleaned. In this manner, principally only the wand apparatus 11 and water source 10 must be removed from the van 2. Subsequent to use, the wand assembly 11 and water source 10 may be returned to the van 2 for storage in the cargo area 15.

The support frame 5 (FIG. 3) is in general a sled type structure having a rectangular base 19, upright struts 20, and cross beams 21 supported by the tops of the struts 20. The structure of the support frame 5 is securely fastened together by welding, bolts or the like. Also utilized in the apparatus for support are interconnected C-clamp supports 22. Mounted on the front of the base 19 is a control and switching station 25. The switching station 25 is mounted in such a manner as to extend forward of the portion of the apparatus 1 supported by the frame 5 in such a way as to be easily assessable from a person standing outside the van 2. The switching station 25 includes a hot water outlet coupling 26 controlled by a valve 27 and an inlet water coupling 28. The switching station 25 also includes an inlet coupling 29 for providing lubricating oil to the apparatus 1 and an outlet coupling 30 (FIG. 1) for effectively draining oil from the apparatus 1. The switching station 25 includes a pressure indicator 32 (FIG. 2) for indicating the pressure associated with hot water produced by the apparatus 1 and a temperature indicator 33 for also indicating the temperature of the water produced by the apparatus 1. A pressure controller 34 allows control of the pressure delivered to the hot water coupling 26. The switching station 25 can include other gages as are desirable to allow an operator to monitor the operating conditions for the overall apparatus 1.

Mounted on the front end of the support frame is the internal combustion engine 6. The engine 6 is of a fairly conventional design and includes a main engine body 36 (FIG. 3), control apparatus 37 for starting and controlling the speed of the engine, a fuel system 38 for supplying fuel from a gas tank (not shown) to the engine 6 and a pair of exhaust gas discharge ports 40 and 41. The engine 6 also includes a drive shaft 42 which extends rearwardly from the remainder of the engine 6. A battery 43 is electrically connected to the control apparatus 37 of engine 6 for use in starting the engine 6. A suitable engine 6 is a 22 horsepower, 2 cycle Kohler motor with an adjustable operating speed and an operating exhaust temperature at the parts 40 and 41 of approximately 1300° F.

Figure 2:
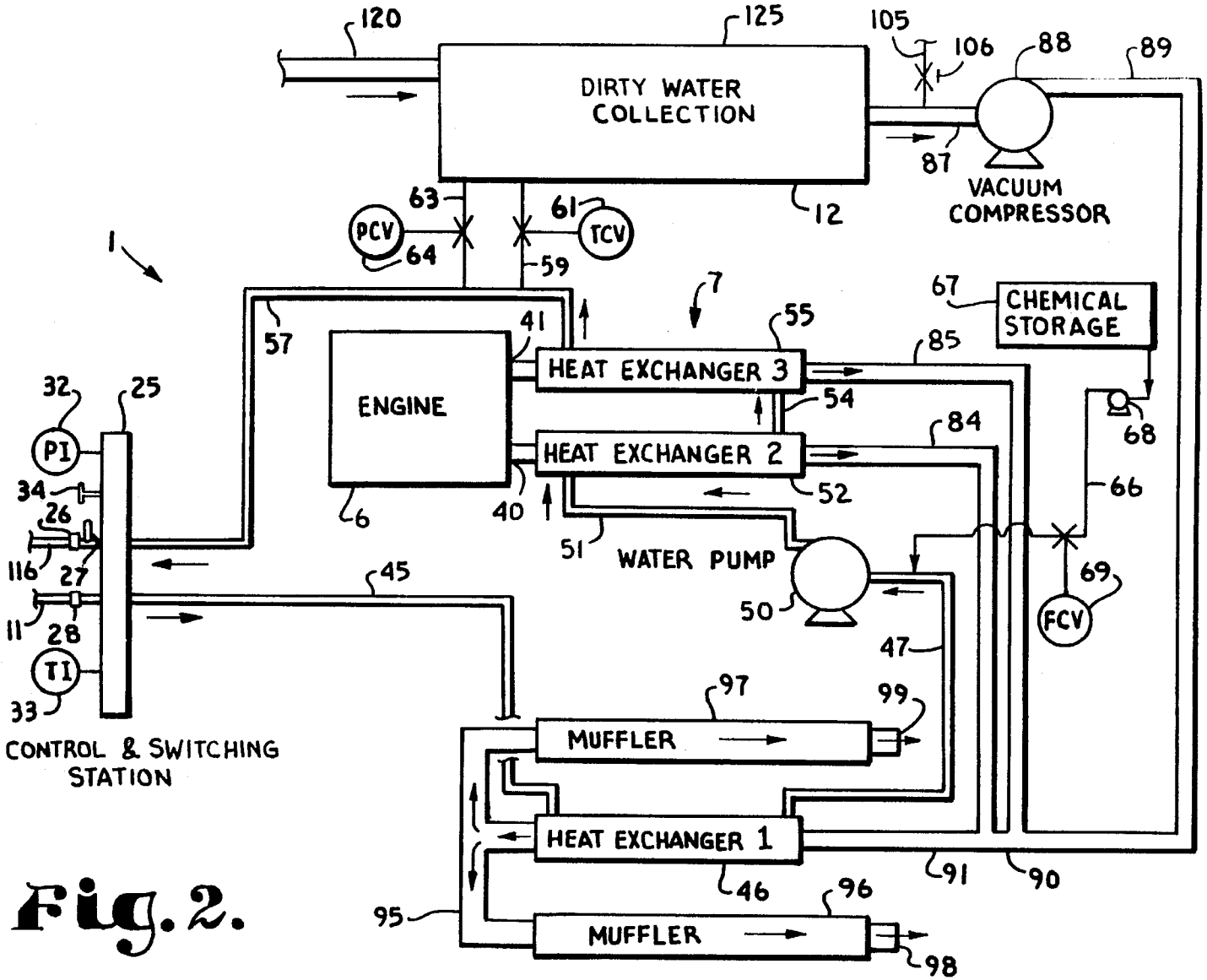
FIG. 2 is a schematic view of the cleaning apparatus.
Figure 4:
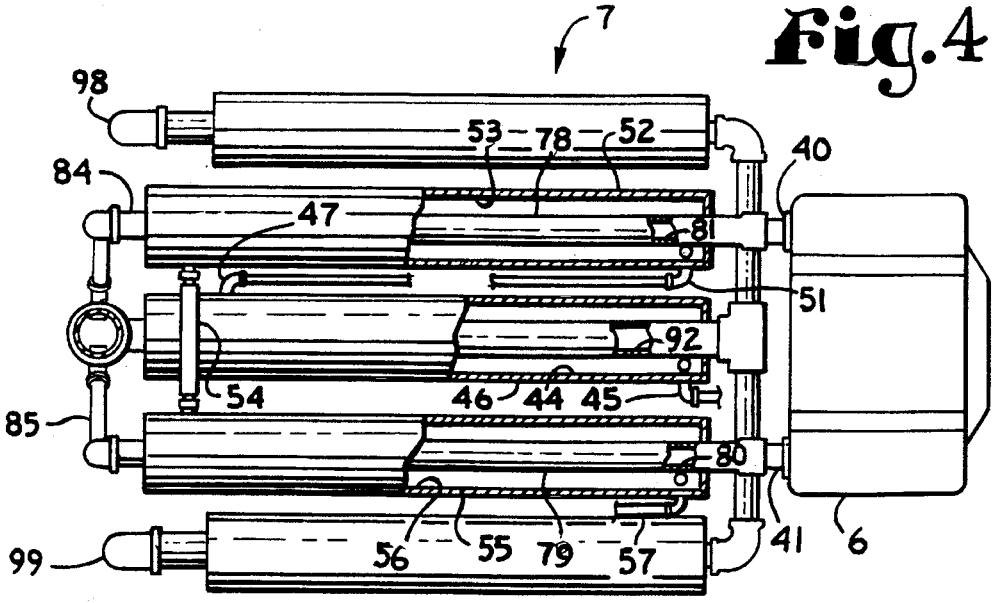
FIG. 4 is an enlarged and partially schematic top plan view of the heated water generating unit, taken along line 4—4 of FIG. 3 with detail simplified to better illustrate certain elements thereof.

The cleaning fluid heating assembly 7 is illustrated somewhat differently in each of the FIGS. 2, 3 and 4 so as to provide as much information as possible about the assembly 7. FIG. 2 is a highly schematic diagram of the heating assembly 7 showing various components of the assembly 7 in a manner that can be easily traced, but also in a manner that is not consistent with the specific positioning of the various pieces within the assembly 7. FIG. 3 provides a more detailed drawing showing the various components in their actual setting, and FIG. 4 is a view from the top of the assembly 7 with a great deal of detail removed to show the main flow path through certain components of the assembly 7.

Flow of fluid into the fluid heating assembly 7 begins at the switching station 25 wherein water is received into the apparatus 1 through the inlet water coupling 28 which connects with piping means that begins with a fluid conduit 45. The fluid conduit 45 flow connects with a shell side 44 (shell interior chamber surrounding tube of exchanger) of a first heat exchanger 46. The water exits the heat exchanger 46 through a fluid conduit 47 and enters a water pump 50.

The water pump 50 draws the water through the water flow system to that point and applies pressure to the water through a control valve 49 so as to initiate pressurization of the water in the heating assembly 7. The water leaves the water pump 50 through a fluid conduit 51 and enters a shell side 53 of a second heat exchanger 52.

The water exits the heat exchanger 52 through a fluid conduit 54 and enters a shell side 56 of a third heat exchanger 55. The water flows through the heat exchanger 55 and exits through a fluid conduit 57 which connects to the hot water outlet coupling 26 of the switching station 25. The exchangers 52 and 55 are sequential in water flow path but are effectively both subexchangers or parts of the primary heat exchanger of the system, whereas the exchanger 46 is considered a secondary exchanger.

The fluid conduit 57 is constructed of material suitable for withstanding relatively high temperatures and pressures of the water within the conduit 57. Preferably, the water is at approximately 30 pounds per square inch pressure and from 140° to 240° F. in temperature in the conduit 57. At the upper temperature range much of the fluid mixture therein will be released as steam whereas at the lower range most of the mixture will be hot water. A first bypass conduit 59 (FIGS. 1 and 2) connects to the conduit 57 and includes a temperature control valve 61 which relieves to allow flow through the entire water system to that location thereby bringing in relatively cool makeup water and preventing overheating of the fluid within the conduit 57. That is, if the fluid in the conduit 57 reaches a preselected temperature, the temperature control valve 61 opens releasing fluid through the bypass conduit 59 into the collection apparatus 12.

A second bypass conduit 63 also flow connects between the conduit 57 and the collection apparatus 12. Flow through the bypass conduit 63 is controlled by a pressure control valve 64 in such a way that pressure within the conduit 57 is controlled to maintain the pressure in conduit 57 below a preselected pressure. That is, if the pressure in the conduit 57 reaches the preselected pressure, then the pressure control valve 64 opens to relieve water from the conduit 57 into the collection apparatus 12 and thereby release the pressure in conduit 57.

Also connected to the fluid conduit 47 is a chemical addition conduit 66. The chemical addition conduit 66 is in turn connected to a chemical addition tank 67 through a pump 68. A flow control valve 69 is also placed along the chemical addition conduit 66 to control flow of fluid through the conduit 66. In this manner cleaning chemicals, such as are conventionally used in the industry, can be added to the water being heated by the heating assembly 7 so as to be metered into the conduit 47 just prior to the water pump 50.

As is seen in FIG. 3, the water pump 50 includes drive pulley 73 connected by a drive belt 74 to a power take off pulley 75 that is mounted on and rotates with the output drive shaft 42 of the engine 6.

Tubes 78 and 79 (FIG. 4, inside respective shells) of the second and third heat exchangers 52 and 55 are directly mounted on the exhaust gas discharge ports 40 and 41 respectively of the engine 6. The tubes 78 and 79 are bayonet type construction and have interior passageways 80 and 81 (also referred to as tube side of a heat exchanger) respectively that are substantially uniform in cross section and free of obstruction through the entire length of the heat exchangers 52 and 55. In this manner the heat exchanger interior passageways 80 and 81 receive hot exhaust gas directly from the engine in a manner that prevents substantial cooling of the gas prior to entry of the heat exchangers 52 and 55. The tubes 78 and 79 as well as the passageways 80 and 81 associated therewith extend straight out from the respective exhaust ports 40 and 41. That is, the passageways 80 and 81 are generally perpendicularly aligned with respect to the ports 40 and 41. The heat exchanger tubes 78 and 79 are constructed of a metal that is suitable for withstanding the heat of the exhaust gases without substantial warping or damage. Preferably the tubes 78 and 79 are constructed of 304 stainless steel.

The engine exhaust gases exit the heat exchangers 52 and 55 through a pair of gas conduits 84 and 85 respectively.

A vacuum conduit 87 (FIGS. 1 and 2) connects the dirty water collection apparatus 12, which will be discussed later, with a vacuum generating means, such as the illustrated vacuum compressor 88 which effectively creates a vacuum or suction within the vacuum conduit 87 and draws gases therethrough. It is foreseen that other types of vacuum producing devices such as a blower could be used for this purpose. The gases drawn through the compressor 88 exit through a conduit 89. The conduit 89 merges with the exhaust gas conduits 84 and 85 at junction 90 so as to mix the gases passing through the conduit 89 with the gases in the conduits 84 and 85 which are then conveyed by a conduit 91 to the entry of a tubular passageway 92 (FIG. 4, tube side) of the heat exchanger 46. The gas exits the first heat exchanger 46 and passes into a bifurcated exhaust conduit 95 which conveys the gas to a pair of mufflers 96 and 97. Each muffler 96 and 97 exhausts through an exhaust port 98 and 99 respectively to the atmosphere.

The compressor 88, in the same manner as the water pump 50, is driven by the drive shaft 42 of the engine 6. In particular, a drive pulley 101 (FIG. 3) mounted on the drive shaft 42 is connected to and effectively operates the compressor 88, through a drive belt 102 rotating a pulley (not shown) of the compressor 88. The compressor 88 is mounted on the support frame 5, as is seen in FIG. 3. An oil line 104 is secured to the compressor 88 and allows selective draining of oil from the compressor to the oil outlet coupling 30 (FIG. 1) on the switching station 25 in a manner controlled by a valve (not shown). Likewise oil can be injected into the vacuum conduit 87 just prior to entry into the compressor through an oil line 105 (FIG. 2) controlled by a valve 106. The oil line 105 is connected to the inlet oil coupling 29 on the switching station 25 and allows oil to be injected into the compressor at the end of the working day to provide lubrication and reduce corrosion of the interior of the compressor 88.

The fluid heating assembly 7 is covered by a cover 108, seen in FIG. 1. It is also noted that the supports 22 join the heat exchangers 52 and 55 to help maintain proper spacing and help prevent vibration. The conduits 84 and 85 are also preferably constructed of a rigid tubing to help support the exchangers 52 and 55.

The water source 10 shown in the illustrated drawings is a hose 110 of a conventional type which is suitable for hooking up to an outside water faucet or the like. Normally during the use of the apparatus 1 the water source hose 110 is joined at one end thereof to the water inlet coupling 28 and to a water outlet on a house or the like at the opposite end. The hose 110 is in this way continuously able to supply water to the apparatus 1 as needed. It is foreseen that in some instances cleaning must be done at a site where a water source is not readily available. In such situations an additional water storage tank will be carried in the van cargo area 15 to supply water to the hose 110.

The cleaning wand assembly 11 is effectively the apparatus that is actually taken to the site where cleaning is required. For example, the cleaning wand assembly 11 may be used in conjunction with the cleaning of a rug 111 (FIG. 1) at a house or at a commercial installation, furniture, drapery or the like. The wand assembly includes a head 112 attached to a handle 113. The head includes an interior spray nozzle 114. A hot water hose 116 connects the hot water outlet coupling 26 of the switching station 25 to the nozzle 114. An intermediate valve controlled by a hand actuator 118 controls the amount of fluid allowed to pass through the hose 116 and out the nozzle 114. It is foreseen that for certain applications a wide variety of heads, nozzles or other distribution devices could be utilized for the illustrated head.

A vacuum reclamation line 120 is connected to the head 112 and opens to the interior of the head 112. The vacuum reclamation line 120 includes a valve which is controlled by a hand actuator 121 located on the handle 113. The end of the reclamation line 120 opposite the head 112 is connected to and opens into a tank 125 of the dirty water collection apparatus 12.

The collection apparatus 12, as noted, includes a collection tank 125 for collecting water drawn through the vacuum reclamation line 120 by the compressor 88. The tank 125 includes a clean out drain 126 controlled by a valve 127. The tank 125 includes a opening 128 in the top thereof normally covered by a lid 129 to allow an operator to clean the tank. Preferably the interior of the tank includes baffles arranged to induce water drawn through the reclamation line 122 to remain in the tank 125 as gases are drawn therefrom by the compressor 88.

During operation of the apparatus 1, water is drawn through the hose 110 into the first heat exchanger 46 by the water pump 50 where the water is heated by secondary heat sources which include residual heat in the exhaust gases entering the heat exchanger from conduits 84 and 85 and heat contained within the gases entering the heat exchanger from the vacuum compressor 88. The gases from the vacuum compressor 88 include steam and/or water vapor withdrawn from the material being cleaned which has passed through the reclamation line 120 as well as heat produced within the vacuum compressor 88 itself. Typically, the temperature of the gases from the compressor is in the range of from 110° to 120° F. with a maximum of about 240° F. In particular, when the vacuum compressor 88 is working hard, the gases passing therethrough are substantially heated and conveyed through the conduit 89 to mix with the residual exhaust gases to enter the first heat exchanger 46. The temperature of the exhaust gases in the conduits 84 and 85 is typically in the range from 600° to 800° F.

Heat is transferred from the combined gases which pass through the conduit 91 into the first heat exchanger to the water in the shell side 44 (FIG. 4) thereof to preheat the water. The water is then pumped by the pump 50 into the shell side 53 of the second heat exchanger 52. While passing through the second heat exchanger 52 the water is substantially heated by the exhaust gases exiting the engine through discharge port 40. The water then passes into the third heat exchanger 55 and passes countercurrent to the exhaust gases exiting the engine 6 through discharge port 41, so as to be heated thereby.

The water is heated so as to be in the range between 140° and 240° F. Preferably the water is finally heated to approximately 230° and about approximately 30 pounds of pressure. The heating assembly and, in particular the conduit 57, is protected against too great a temperature or pressure by preselected settings of the temperature control valve 61 and pressure control valve 64.

The heated water leaves the fluid heating assembly 7 through the hot water outlet coupling 26 and passes into the hot water outlet hose 116 for conveyance to the wand assembly 11. At the wand assembly 11 the hot water is sprayed through the nozzle 114 under control of the hand actuator 118 so as to be sprayed on the material to be cleaned such as carpeting or the like. Once sprayed, the vacuum reclamation line is actuated so as to pull the vacuum on the interior of the head 112 to withdraw excess condensed water, dirt and excess steam from the material being cleaned.

The vacuumed materials are drawn through the reclamation line 120 to the tank 125 wherein at least part of the condensed water and dirt are preferably allowed to accumulate at the bottom of the tank 125 while steam, water vapor and other gases are drawn through the compressor 88. The gases passing through the compressor are further heated by the work of the compressor 88 and discharged into the conduit 89. The exhaust gases that have passed through the heat exchangers 52 and 55 join with the exhaust of the compressor 88 at the junction 90 and are passed through the first heat exchanger 46 for preheating the water as previously described. The gases then pass through mufflers 96 and 97 so as to discharge into the atmosphere.

The present invention allows preheating of the water with heat withdrawn from the exhaust gases that has not been completely withdrawn by the primary heat exchangers which are the second heat exchanger 52 and the third heat exchanger 55. The system also allows recovery of the heat which exists in the gases exiting the compressor 88 which is produced both by internal work of the compressor 88 and by recovery of steam and the like from the carpet or other object being cleaned in the secondary heat exchanger which is heat exchanger 46. In this manner the heat produced by the system is very efficiently used to produce new hot water for the use in cleaning without wasting a substantial amount of the heat which would otherwise be wasted to the atmosphere.

The present system also allows for the very effective exchange of heat between the exhaust gases exiting the engine and the water being heated thereby. In particular, the heat exchangers 52 and 55 for exchanging heat between the water and the exhaust gases are placed to receive the exhaust gases directly from the engine 6, so that the exhaust gases are not allowed to cool substantially before entering the heat exchangers 52 and 55. Many prior art devices of this type require the use of a substantial amount of piping between the engine and the primary heat exchangers so that the gas will somewhat cool and deform by melting the exchanger, as conventional exchangers used for this purpose are constructed of copper or other material that cannot withstand the heat of the exhaust gases directly from the engine 6. Consequently, a substantial amount of heat is wasted to the air by conduction through the conveying piping prior to entering the heat exchangers in the conventional devices. This is avoided in the present apparatus and provides for very efficient heating of the water.

The combining of the recovery of the heat to preheat the water within the secondary heat exchanger 46 and the very efficient use of the second and third heat exchangers 52 and 55 allow for a high rate of production of hot water within the present system so that hot water is readily available on demand by the users even when there is a substantial load placed upon the apparatus 1.

It is to be understood that while certain forms of the present invention have been illustrated and described herein, it is not to be limited to the specific forms or arrangement of parts described and shown.

What is claimed and desired to be secured by Letters Patent is as follows:

1. A cleaning apparatus for supplying a heated water fluid for cleaning; said apparatus comprising:

a) primary heat generating means;

b) a primary heat exchanger adapted to cooperate with water supply means so as to operably receive water therefrom and transferring heat produced in said heat generating means to the water received therein so as to produce the heated water fluid;

c) a cleaning assembly having a cleaning head flow connected to said primary heat exchanger and adapted to use said fluid for cleaning at a use site;

d) vacuum producing means flow connected to said head and selectively producing a vacuum at said head to withdraw reclaimed fluid from the use site;

e) collection means for collecting dirty water within the reclaimed fluid;

f) a secondary heat exchanger flow connected to an exhaust of said vacuum producing means and receiving hot gases passed through and further heated by said vacuum producing means; said secondary heat exchanger also receiving and heating water to be heated prior to said primary heat exchanger with said vacuum producing means exhaust so as to preheat the water.

2. The apparatus according to claim 1 wherein:

a) said heat generating means is an internal combustion engine having at least one exhaust port for exhausting engine exhaust gases; and b) said primary heat exchange is positioned to receive said engine exhaust gases substantially directly from said exhaust port.

3. The apparatus according to claim 2 wherein:

a) said primary heat exchanger is a shell and tube heat exchanger having the tube thereof substantially directly connected to said engine exhaust port and being generally straight with a passageway in said tube being aligned to project substantially perpendicular to said exhaust port.

4. The apparatus according to claim 1 including:

a) overpressure release means flow connected to a discharge of said primary heat exchanger and said collection means for allowing release of water into said collection means if the pressure of the water at the discharge exceeds a preselected pressure.

5. The apparatus according to claim 1 including:

a) excess temperature relief means flow connected between the discharge of said primary heat exchanger and said collection means for allowing the release of water heated beyond a preselected temperature from said discharge to said collection means so as to allow flow of cooler water into the primary heat exchanger.

6. A cleaning apparatus for supplying a heated water fluid for cleaning; said apparatus comprising:

a) primary heat generating means;

b) a primary heat exchanger adapted to cooperate with water supply means so as to operably receive water therefrom and transferring heat produced in said heat generating means to the water received therein so as to produce the heated water fluid;

c) a cleaning assembly having a cleaning head flow connected to said primary heat exchanger and adapted to use said fluid for cleaning at a use site;

d) vacuum producing means flow connected to said head and selectively producing a vacuum at said head to withdraw reclaimed fluid from the use site;

e) collection means for collecting a dirty water portion of the reclaimed fluid;

f) a secondary heat exchanger flow connected to an exhaust of said vacuum producing means and receiving hot gases passed through and further heated by said vacuum producing means; said secondary heat exchanger also receiving and heating water to be heated prior to said primary heat exchanger with said vacuum producing means exhaust so as to preheat the water;

g) said heat generating means being an internal combustion engine having at least one exhaust port for exhausting engine exhaust gases;

h) said primary heat exchange being positioned to receive said engine exhaust gases substantially directly from said exhaust port; and i) piping means for flow connecting said engine exhaust gases, after passing through said primary heat exchanger, with the vacuum producing means exhaust prior to said secondary heat exchanger, such that residual heat in said engine exhaust gases subsequent to said primary heat exchanger partially preheats the water in the secondary heat exchanger.

7. The apparatus according to claim 6 wherein:

a) said engine has a pair of exhaust ports;

b) said primary heat exchanger includes a pair of straight tubed sub-exchangers with one thereof mounted to extend directly outward from a respective one of said ports; and c) second piping means is configured to direct water to be heated sequentially through said sub heat exchangers.

* * * * *